US007555852B2

(12) United States Patent
Emerson

(10) Patent No.: US 7,555,852 B2
(45) Date of Patent: Jul. 7, 2009

(54) SNOWSHOE BINDING WITH CONTOURED BASE

(75) Inventor: Daniel T. Emerson, Berkeley, CA (US)

(73) Assignee: K-2 Corporation, Seattle, WA (US)

( * ) Notice: Subject to any disclaimer, the term of this patent is extended or adjusted under 35 U.S.C. 154(b) by 124 days.

(21) Appl. No.: 11/335,179

(22) Filed: Jan. 18, 2006

(65) Prior Publication Data

US 2007/0163152 A1 Jul. 19, 2007

(51) Int. Cl.
*A43B 5/04* (2006.01)

(52) U.S. Cl. ..... 36/124

(58) Field of Classification Search ..... 36/122–125
See application file for complete search history.

(56) References Cited

U.S. PATENT DOCUMENTS

| | | | | | |
|---|---|---|---|---|---|
| RE25,472 | E | * | 11/1963 | Howe | 36/125 |
| 4,604,817 | A | * | 8/1986 | Ramboz | 36/125 |
| 4,720,928 | A | * | 1/1988 | Faber et al. | 36/122 |
| 5,259,128 | A | | 11/1993 | Howell | |
| 5,493,794 | A | | 2/1996 | McKenzie et al. | |
| 5,787,612 | A | | 8/1998 | Mahoney et al. | |
| 5,918,387 | A | | 7/1999 | Emerson | |
| 6,814,360 | B2 | * | 11/2004 | Kiniry et al. | 280/11.3 |
| 7,461,471 | B2 | | 12/2008 | Kiniry et al. | |
| 7,472,497 | B2 | | 1/2009 | Emerson et al. | |
| 2003/0126765 | A1 | | 7/2003 | Messmer et al. | |

FOREIGN PATENT DOCUMENTS

| | | |
|---|---|---|
| WO | WO2007084580 | 7/2007 |

* cited by examiner

*Primary Examiner*—Ted Kavanaugh
(74) *Attorney, Agent, or Firm*—Thomas M. Freiburger

(57) ABSTRACT

A binding for a snowshoe has an injection molded base or footbed with integral control wings for cradling the shoe generally as in U.S. Pat. No. 5,259,128. The base preferably has toe stops at the forward end, positioned asymmetrically on the base to better individually contour to the left shoe and the right shoe. At the inner side of the foot the toe stop is farther forward. The lower end of the arch side control wing is positioned to cradle the shoe arch while the outer side control wing is at an offset position to engage an aft area of the shoe. Also, the width of the binding can be adjustable at the arch. These features provide a better connection of the snowshoe to the shoe, greater stability in use of the snowshoe and greater comfort to the user.

3 Claims, 3 Drawing Sheets

SNOWSHOE BINDING WITH CONTOURED BASE

BACKGROUND OF THE INVENTION

This invention concerns snowshoe bindings, and relates in particular to an improved binding of the type having a molded footbed or base with side wings or control wings at opposite sides approximately at the arch region.

U.S. Pat. No. 5,259,128, owned by the assignee of the current invention, discloses a snowshoe with a binding having a molded plastic base that includes "support arms" positioned to cradle the-shoe or boot at left and right generally at the arch region. These help hold the boot closely and stably in the binding, tending to prevent rotation of the boot relative to the snowshoe in use. The lateral support arms have sometimes been referred to in the industry as "control wings", and they are referred to in that way herein.

U.S. Pat. No. 5,259,128 is incorporated herein by reference.

The invention described below provides improvements to the control wing concept, including left-foot and right-foot specific bindings, further resulting in a binding that firmly and stably holds the shoe in place against relative rotation of the shoe with the snowshoe, and also providing increased comfort to the user.

SUMMARY OF THE INVENTION

According to the current invention, a binding for a snowshoe has an injection molded base or footbed with integral control wings for cradling the shoe generally as in U.S. Pat. No. 5,259,128. The bindings of the invention are asymmetrical, specific to each of the left and right feet. The base may have toe stops at the forward end, and if so they are positioned asymmetrically on the base to better individually contour to the left shoe and the right shoe. At the inner side of the foot the toe stop is farther forward, reflecting the different shapes of the shoe at front medial, versus front lateral, sides. In addition, the lower end of the arch side control wing is positioned to cradle the shoe arch while the outer side control wing is at an offset position primarily to engage an aft area of the shoe. Also, the width of the binding can be adjustable at the arch. These features align the foot with the center of the snowshoe, and provide a better connection of the snowshoe to the shoe, greater stability in use of the snowshoe and greater comfort to the user.

In one embodiment the injection molded control wings are adjustable as to separation, thereby better accommodating different widths of users shoes. For this purpose the base or footbed can be in two sections, a main base section and a slidable or pivoted section that moves in/out at the medial or inner side, i.e. the arch side.

It is thus among the objects of the invention to improve the stability, reliability and comfort of the binding on a snowshoe. These and other objects, advantages and features of the invention will be apparent from the following description of a preferred embodiment, considered along with the accompanying drawings.

DESCRIPTION OF THE PREFERRED EMBODIMENTS

Figure 1:
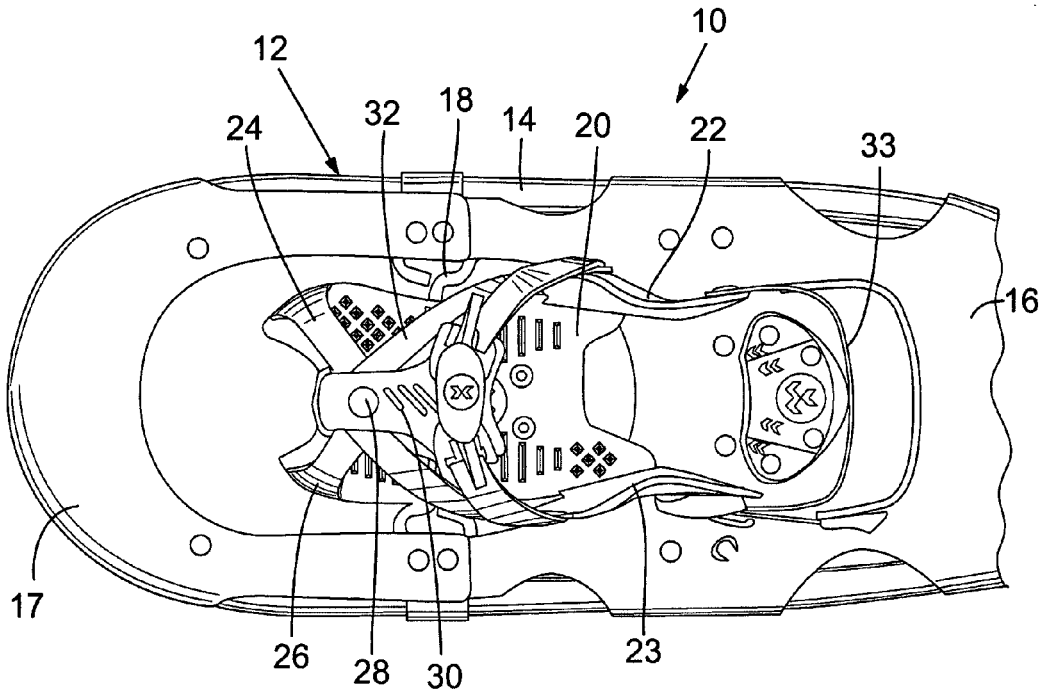
FIG. 1 is a top plan view showing a portion of a snowshoe with a binding according to the invention.

FIG. 1 shows most of a snowshoe 10 in plan view, including a binding 12 of the invention. The snowshoe has a frame 14 that supports decking 16, 17, and the binding 12 in this embodiment is supported on a pitch pivot, by a pivot rod 18. The binding has a footbed or base 20, which can be formed in one or more pieces, but which has control wings 22 and 23 at inner and outer sides, these control wings preferably being integrally molded with the footbed. At the front end of the footbed or base member 20 in this embodiment are a pair of toe stops 24 and 26, and these can take a variety of forms. In this case the toe stops are relatively stiff but flexible strap-like pieces that extend up integrally from the front of the footbed to a connection point 28 with a tongue 30, where straps 32 are also connected. In other forms, the toe stops can be short upward extensions of the footbed, onto which other binding elements, such as a larger tongue or other harness member, can be connected.

Figure 2:
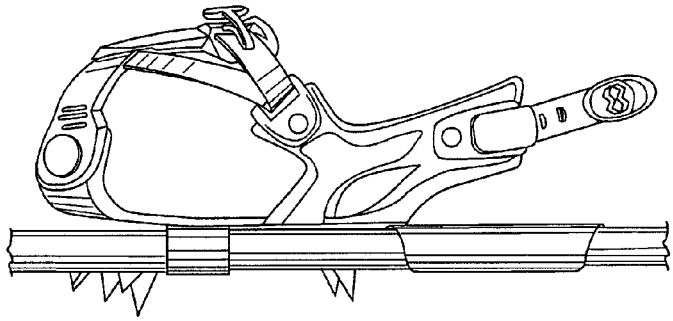
FIG. 2 is a side elevation view of the snowshoe and binding of FIG. 1.
Figure 3:
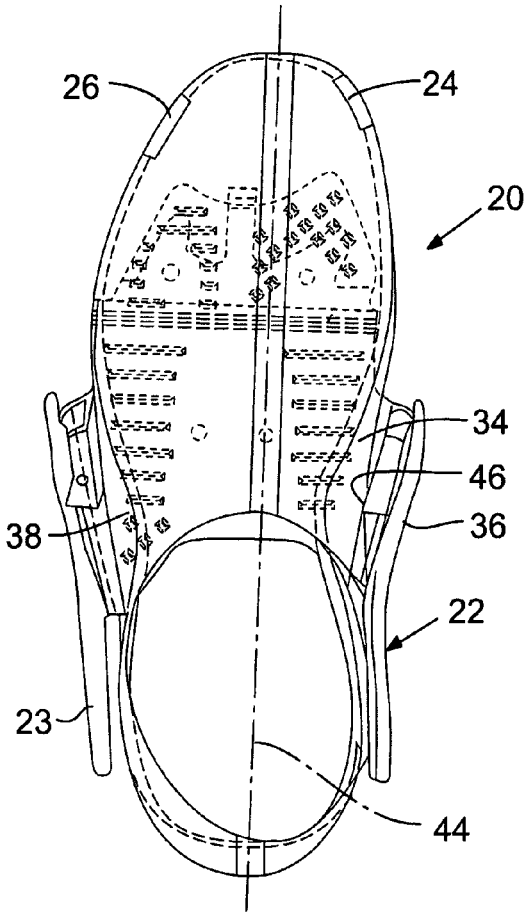
FIG. 3 is a top plan view showing schematically the positions of components in the binding.
Figure 4:
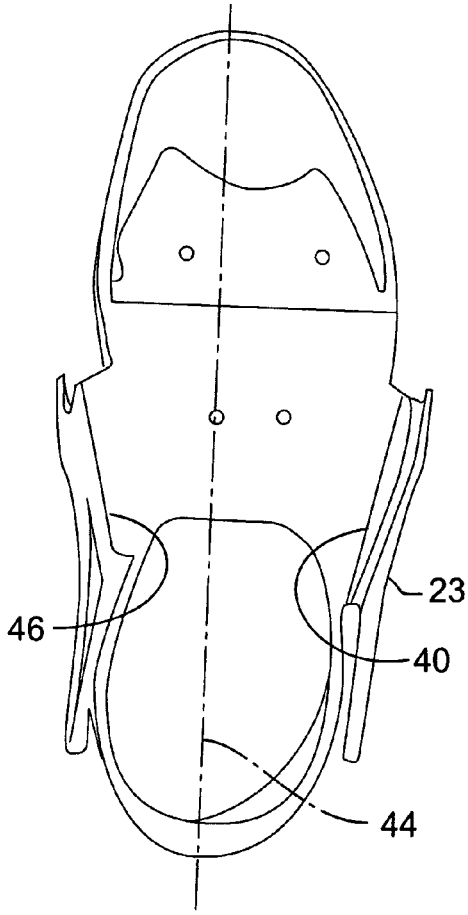
FIG. 4 is a bottom plan view of the binding of FIG. 3.

FIG. 2 shows this assembly and configuration in a fragmented side elevation view, and FIGS. 3 and 4 show the footbed schematically in top and bottom plan views, to indicate positions of major features.

This invention recognizes the non-symmetrical nature of a foot, and the differences between left and right feet of a user. Prior bindings, including that of the patent referenced above, did not take into account the nonsymmetrical foot. Here, however, the binding is designed to recognize the very different inner and outer contours of the foot, in the toe and ball of the foot and at the arch. The arch of a shoe on the medial or inner side is a strong feature, an indentation and upwardly arched region of the foot that is important to properly cradle and contact with the binding, for stability and comfort. At the opposite, outer side of the foot, some shoes have an indentation, but more of a simple taper back to the narrower heel. The area for best engagement is generally slightly farther back than the arch on the shoe. Some shoes simply have a gradual taper that does not indent at this lateral side. An important feature of the invention is to align the foot with the center line of the snowshoe. The control wings are shaped to better contour to the shoe, tending to better center the foot and with greater stability and also comfort, as compared to prior art ambidextrous snowshoe bindings.

Thus, FIGS. 3 and 4 show that the control wings 22 and 23 of the binding are configured to contour to the arch region at the inner side and to the shoe contour at the outer side. As indicated by the dashed lines in FIG. 3, the medial arch region is at 34, with a forward part 36 of the control wing 22 engaging this region. This forward part 36 has a base region 46 where the wing joins to the horizontal platform. On the opposite side, the shoe may have a slight indentation 38 opposite the arch region, but this is generally slightly farther back on the shoe. As noted above, some shoes and boots have almost no indentation in this area. The control wing 23 on the outer side of this left-foot binding in FIG. 3 can be almost straight at its top edge, but with a shape at its lower end where it meets the platform of the footbed tapering inwardly to the rear, as best seen in FIG. 4, a bottom plan view. FIG. 4 shows that the base end or base region 40 of the control wing 23 forms an inwardly tapering configuration in the rearward direction, and also shows that the back edge of the control wing base region 40 preferably extends farther back in the binding than the base 46 on the arch side.

FIG. 3 also shows the inner and outer toe stops 24 and 26, and preferred relative locations for these toe stops. The inner toe stop 24 is farther forward in this preferred embodiment than the outer toe stop 26, which can also be seen in FIG. 1. This has been found to provide better stability in retaining the foot firmly in place in the snowshoe and relates to some extent to the anatomy of the foot and the application of forces from the shoe to the binding in use of the snowshoes. FIGS. 3 and 4 include a center line 44 of the boot, which appears to be somewhat toward the inner side of the foot but is based on the location of the ankle and the musculo-skeletal anatomy of the foot and ankle. This center line defines approximately the center where the user's weight is applied.

The footbed base 20 of the binding thus has important non-symmetrical aspects that are more custom fitted to the particular intended foot. These foot-specific asymmetrical features are important because of the location of the boot center line 44, which should be aligned with the snowshoe, and because of the accompanying differences in the foot and boot between left and right, particularly the location and geometry of the arch 34 at the inner or medial side of the foot. The arch-engaging region 36, primarily where the control wing meets the platform at the base region 46, preferably is farther forward along the boot center line 44 and its counterpart 40 on the opposite side, or at least the midpoint of the control wing base region 46 is farther forward than the midpoint of the longer base region or connection 40 at the opposite side.

Solid lines and dashed lines in FIG. 3 indicate different shoe outlines for different shoe sizes and shapes. The contoured footbed 20 is designed to fit well to such different shapes.

Figure 6:
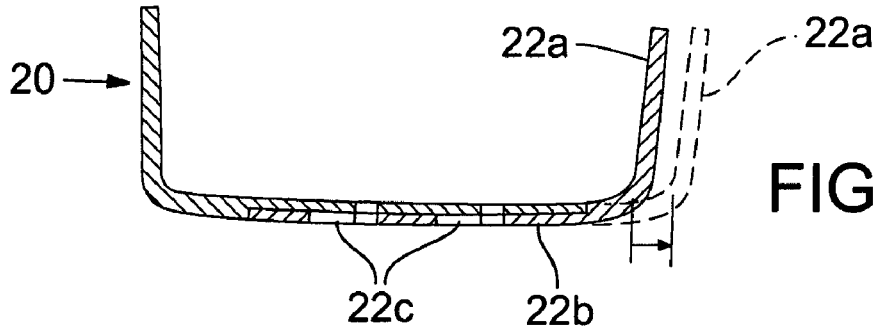
FIG. 6 is a transverse cross sectional view taken along the line 6-6 in FIG. 5.
Figure 5:
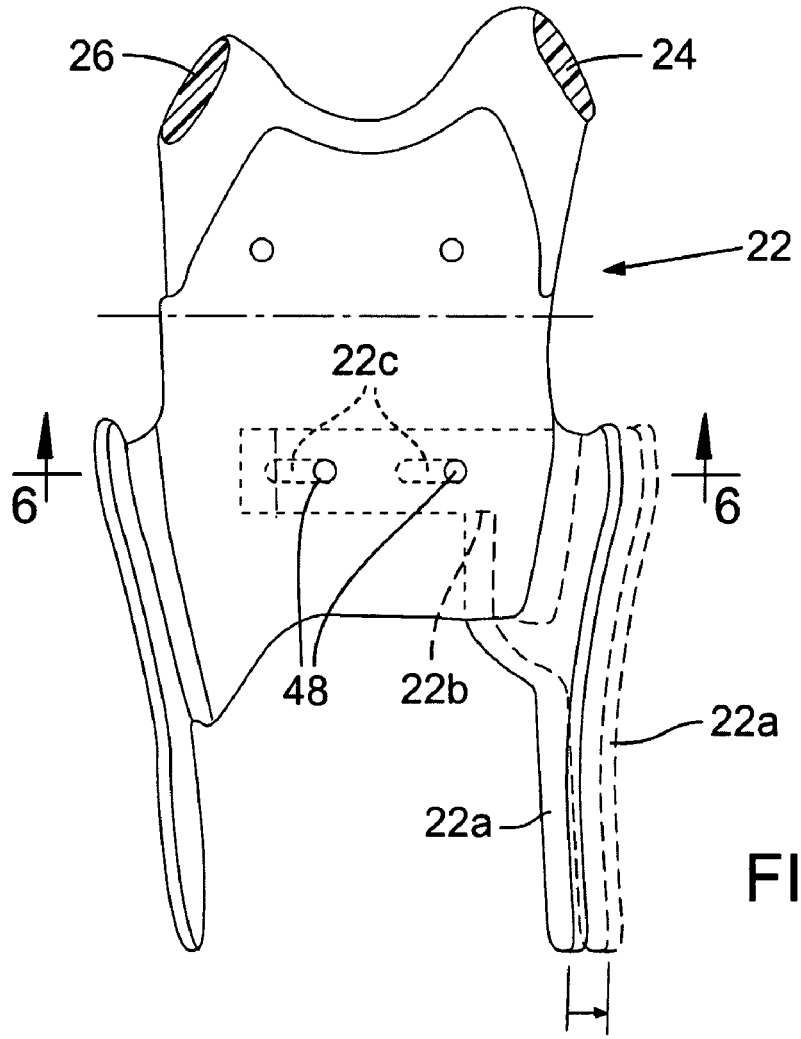
FIG. 5 is a schematic plan view showing a binding footbed or base platform having a means for adjustment of width at the arch.

FIGS. 5 and 6 show a variation of the binding and footbed described above, wherein adjustment for different shoe widths is provided. In FIG. 5 the footbed 20 is shown, essentially in the asymmetrical form illustrated in FIGS. 3 and 4, but with a slide adjustment feature whereby the medial or inner control wing 22*a* is adjustable in lateral position. This can be accomplished by forming the inner control wing as a separate component, with an extension at 22*b* that is under the platform of the footbed and is connected via slotted holes 22*c* on the extension and fasteners 48. The control wing 22*a* can be pulled out for insertion or removal of a user's shoe, and can be moved inwardly or locked by an appropriate form of threaded device or ratchet. Alternatively, if the slide arrangement is formed so as to exhibit low friction and without tendency to bind, the medial control wing 22*a* can simply be pulled inwardly by the binding straps 32 as the user tightens the binding straps 32 and a rear strap 33 (see FIG. 1) when the user tightens the binding, without a locking device.

Although a slide function is shown in FIGS. 5 and 6, another principal embodiment for providing the adjustment is a pivot, along a vertical pivot axis at a forward location in the footbed. The control wing 22*a* can have extension structure which reaches farther forward onto the main portion of the footbed 20, swinging about the forward pivot, so that the arch control wing assumes a position to fit the particular shoe. The pivot version is well adapted to being secured at the inward, arch-engaging position under the influence of the binding straps, so that it can swing outward freely when the straps have been loosened and the binding released.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A snowshoe binding having a molded base, comprising:

a molded base formed of a semi-rigid strong plastic material, a pair of control wings integrally molded with the base and extending integrally and abruptly upward from the base at each of inner and outer sides of the binding, the control wings being elongated and extending through the arch region of a user's foot and shoe and being semi-rigid, the control wing at the inner side being angled to form a prominent indentation at the arch of the user's foot and shoe and being configured to contour to the arch region at the inner side, the two control wings being asymmetrical and different in configuration so as to conform to the respective inner and outer sides of the foot and shoe of a user, a pair of toe stops at the forward end of the base, at inner and outer positions on the base, each toe stop integrally molded with the base and extending upwardly from the base, each toe stop being semi-rigid and providing an abrupt, fixed stop position for the toe end of a user's shoe, the two toe stops being at asymmetrical positions on the binding, with the inner toe stop being farther forward on the base than the outer toe stop, and the asymmetrical configurations of the control wings and the asymmetrical positions of the toe stops being dedicated particularly to a left foot or a right foot, whereby a user's shoe can be held firmly and stably in the binding and in proper alignment with a snowshoe to which the binding is attached, against movement or relative rotation of the foot with a snowshoe, and with increased comfort to the user.

2. A snowshoe binding having a molded base, comprising:

a molded base formed of a semi-rigid strong plastic material, a pair of control wings, secured to the base and extending abruptly upward from the base at each of inner and outer sides of the binding, the control wings being semi-rigid and elongated and extending through the arch region of a user's foot and shoe, the control wing at the inner side being angled to form an indentation at the arch of the user's foot and shoe and being configured to contour to the arch region at the inner side, the two control wings being asymmetrical and different in configuration so as to conform to the respective inner and outer sides of the foot and shoe of a user, the outer side control wing being integral with the base and extending integrally upwardly from the base, and the inner side control wing being slidable laterally on the base to adjust the width of the binding to different widths of users' shoes, the inner side control wing having a horizontal extension connected to the base so as to allow lateral sliding adjustment, a pair of toe stops at the forward end of the base, at inner and outer positions on the base, each toe stop integrally molded with the base and extending upwardly from the base, each toe stop being semi-rigid and providing a fixed stop position for the toe end of a user's shoe, the two toe stops being at asymmetrical positions on the binding, with the inner toe stop being farther forward on the base than the outer toe stop, and the asymmetrical configurations of the control wings and the asymmetrical positions of the toe stops being dedicated particularly to a left foot or a right foot, whereby a user's shoe can be held firmly and stably in the binding and in proper alignment with a snowshoe to which the binding is attached, against movement or relative rotation of the foot with a snowshoe, and with increased comfort to the user.

3. A snowshoe binding as in claim 2, including straps connected to the control wings and positioned to extend over a user's shoe, the straps being positioned to draw the slidable inner side control wing inwardly against the boot when tightened.

* * * * *